United States Patent [19]

Puckett

[11] Patent Number: 4,958,571

[45] Date of Patent: Sep. 25, 1990

[54] CONTINUOUS-FIBER REINFORCEMENT SABOT

[75] Inventor: Lawrence J. Puckett, Churchville, Md.

[73] Assignee: The United States of America as represented by the Secretary of the Army, Washington, D.C.

[21] Appl. No.: 406,932

[22] Filed: Sep. 13, 1989

[51] Int. Cl.[5] ..... F42B 14/06

[52] U.S. Cl. ..... 102/522

[58] Field of Search ..... 102/520–524, 102/526, 527, 532

[56] References Cited

U.S. PATENT DOCUMENTS

| | | | |
|---|---|---|---|
| 122,014 | 12/1871 | Helm | 102/522 |
| 2,247,563 | 7/1941 | Spalding | 102/523 |
| 2,996,011 | 8/1961 | Dunlap | 102/521 |
| 3,430,572 | 3/1969 | Hebert et al. | 102/521 |
| 3,834,314 | 10/1974 | Young | 102/521 |
| 4,242,961 | 1/1981 | Moredock et al. | 102/526 |
| 4,651,649 | 3/1987 | Nussbaum | 102/521 |
| 4,653,404 | 3/1987 | Halverson | 102/520 |
| 4,658,729 | 4/1987 | Scherbarth et al. | 102/520 |
| 4,747,191 | 5/1988 | Montier et al. | 102/521 |
| 4,833,995 | 5/1989 | Gotz et al. | 102/521 |
| 4,867,067 | 9/1989 | Becker et al. | 102/521 |

FOREIGN PATENT DOCUMENTS

| | | | |
|---|---|---|---|
| 1177047 | 4/1959 | France | 102/522 |

*Primary Examiner*—Chdarles T. Jordan
*Assistant Examiner*—Stephen Johnson
*Attorney, Agent, or Firm*—Saul Elbaum; Freda L. Krosnick

[57] ABSTRACT

A sabot for an armor-piercing fin-stabilized discarding-sabot penetrator is provided formed of continuous filaments wherein the sabot is preferably bucket shaped and the filaments are sufficiently long to be wrapped from the obturator rearward around the projectile base, and forward to the obturator on the opposite side of the sabot. The filaments are formed of glass, pyrolytic graphite or other high tensile strength light weight material. The sabot preferably has grooves to mesh with similar grooves on a penetrator body and some of the filaments are angled into at least a portion of said grooves.

1 Claim, 1 Drawing Sheet

CONTINUOUS-FIBER REINFORCEMENT SABOT

BRIEF SUMMARY OF THE INVENTION

A sabot for an APFSDS (Armor-Piercing, Fin-Stabilized, Discarding-Sabot) penetrator is provided with continuous fiber reinforcements so as to minimize sabot weight and improve penetrator performance.

BACKGROUND OF THE INVENTION

APFSDS penetrators, e.g., FIG. 1, have a high ratio for length to diameter because the depth of penetration into armor is proportional to length of penetrator. The diameter is small, reducing the penetrator mass which must be accelerated in the interior ballistic cycle of the gun. The minimum penetrator diameter is governed primarily by the strength required to prevent bending or breaking in the launch and penetration into the armor. The sabot receives the principal part of the force during the launch acceleration, and must transmit the acceleration force to the penetrator.

Current designs for sabots and penetrators, in APFSDS munitions, incorporate buttress grooves, 5 FIG. 1, to allow the sabot 7 to engage and transmit the acceleration forces to the penetrator 13.

A major design problem confronting sabot development is that of force coupling during the interior ballistic cycle, and sabot discard upon muzzle exit.

This invention provides a means for solving the problem of force coupling through a new design which uses continuous filament reinforcements to reduce the stress on the buttress grooves and, thereby, permit the overall reduction of parasitic sabot weight.

Filamented reinforcements, e.g., glass filaments or carbon filaments, have high tensile strengths/weight, but not high shear strength/weight. Therefore, attempts to exploit the desirable tensile characteristics in a sabot, particularly in the buttress groove area where it is most needed to avert shear failure of the buttress teeth, would not be expected to be successful.

DETAILED DESCRIPTION OF THE INVENTION

Figure 1:
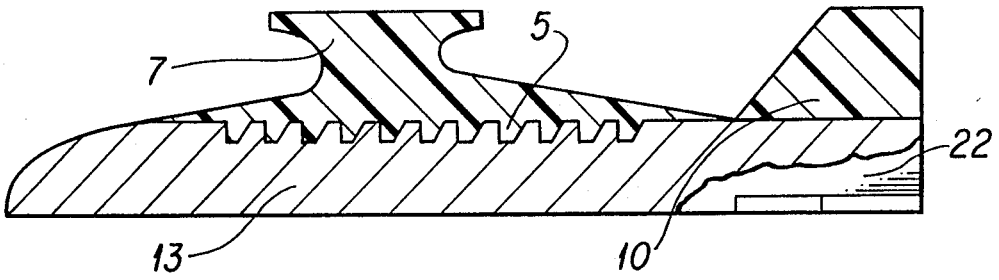
FIG. 1 is a side view of an APFSDS penetrator with sabot.

The teachings within the scope of the present invention which are set forth in the drawings have penetrator body 13, sabot 7, buttress grooves 5, flight stabilizing fins 10, and penetrator base 22.

In accordance with the invention, a sabot 7 is formed of continuous filaments 20, which preferably is of a bucket shape. The key feature of this invention is the manner in which a reinforced, bucket-type sabot 7 (FIG. 2) is designed to provide a major portion of the force-coupling, and, thus, relieve the stress loads in the buttress grooves 5.

The advantage of the bucket design is that it permits the reinforcing continuous filaments 20 to be embedded in the conventional bulk material of the sabot, 7 aligned symmetrically about the axis in a convergent geometry as the filaments 20 run aft in the sabot 7. The filaments 20 extend (continuously) around the rear end base of the penetrator 22 and forward through the conventional bulk sabot material on the sides of the penetrator, 13 thus forming the "bucket."

Figure 2:
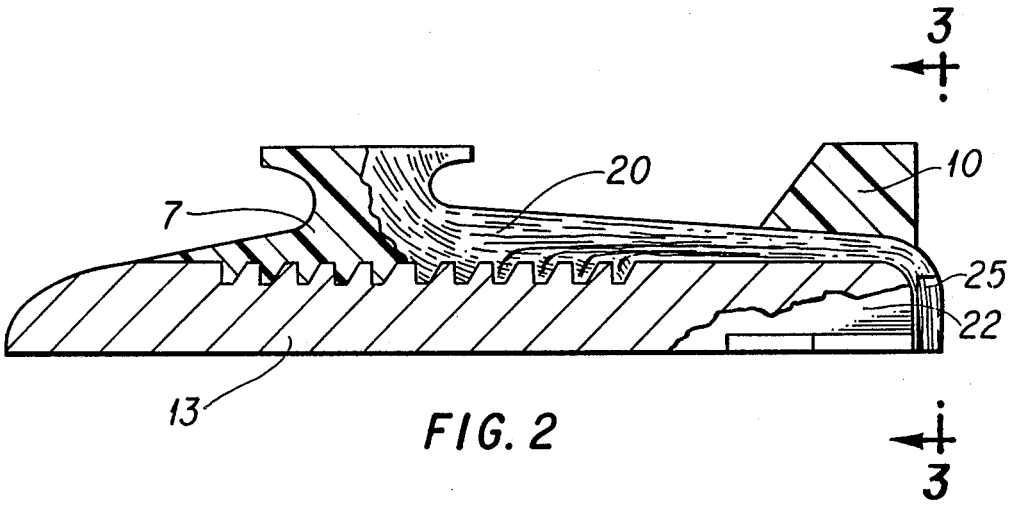
FIG. 2 is a one half cross-sectional view along the longitudinal axis of an APFSDS penetrator with sabot in which the continuous filaments are shown to wrap around the projectile base, and diverge into the conventional sabot bulk material and also into the buttress grooves.

As indicated in FIG. 2, the aft end of the penetrator 22 is preferably rounded in order to avoid sharp-angle bending, and shear stress, in the reinforcing filaments 20.

Figure 3:
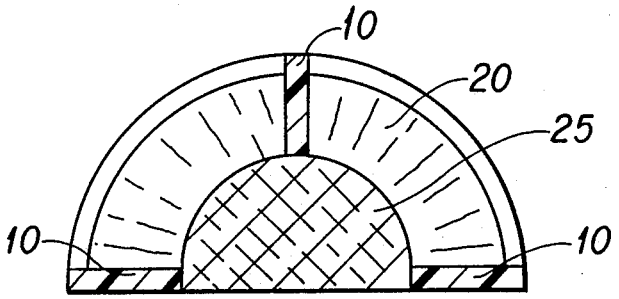
FIG. 3 is an aft view of the sabot with a woven filament base pad, from which the filaments extend forward into the conventional bulk material.

FIG. 3 illustrates one possible wrapping pattern in which use is made of a woven filament matrix 25 to cover the rounded aft end of the penetrator 22. As the filaments 20 extend forward from the aft end, they are preferably not woven, but are separate strands (or bundles).

In FIG. 2 the filaments 20, in their forward run, are illustrated to (a) diverge in the conventional bulk sabot material, and (b) diverge into the buttress grooves, 5 where they provide tensile reinforcement.

With this wrapping technique successive layers of reinforcement and bulk bonding material may be built up about the penetrator. The final shape can be accomplished by either casting techniques and/or machining. The advantages of this design are two-fold.

One, during the interior ballistic cycle a major portion of the driving forces on the sabot are transmitted to the penetrator through the bottom of the "bucket," where the reinforcing filament material is configured to experience predominately tensile forces. Thus, the filaments are used to provide tensile strength, for which their characteristics are best suited, and to relieve, somewhat, the buttress grooves of their burden of transmitting the driving force to the penetrator.

Two, some of the projectile bending moments normally incurred during the travel down the gun barrel are alleviated in which the projectile/sabot experiences transverse forces generated by the non-straight axis of the barrel, the latter being a result of the manufacturing process. For example, in the manufacturing process, gun barrels are straightened mechanically in order to meet overall straightness specifications from breech to muzzle. The resulting barrel, however, may possess many local deflections along its axis. When the projectile/sabot "rides" down such a barrel, the barrel deflections impart transverse accelerations to the sabot. The sabot, which is comparatively elastic with respect to the penetrator, stores elastic energy which it transmits to the penetrator through its contact surfaces. In this fashion, the major transverse force is imparted to the penetrator mid-section, where the sabot coupling is concentrated. With a standard sabot, the result is the transverse acceleration of the mid-section of the penetrator, accompanied by an inertial lag of the unsupported nose and tail sections. The penetrator, therefore, is repeatedly, transversely, elastically bent as it is accelerated down the gun barrel. With the "buckettype" sabot design of this invention, the tail section of the penetrator is supported and resists such deflections. Therefore, the in-flight dispersion of such penetrators will be reduced and the net gun accuracy will be improved.

The sabot may be developed to discard, after muzzle exit, in conventional fashion by either casting or machining of axially aligned divider grooves in the sabot as is current manufacturing practice. Currently, sabots are designed with circumferential retainer rings, which serve to obturate the propellant gases and to retain the sabot pieces about the penetrator. The retainer ring is designed to be broken by the aerodynamic and centrifugal forces of the launch process. A significant departure from current practice, however, is that the continuous filaments in the "bucket" around the aft end of the penetrator will resist, somewhat, the sabot separation process. Therefore, the retaining force provided by the base of the filamented sabot bucket will have to be overcome during launch to allow the sabot to separate radially from the penetrator. This is not a problem because the filaments of the sabot are comparatively weak in the radial, or shear direction of the lay up pattern.

The filaments, which, for example, may be glass, pyrolytic graphite or other high tensile strength light weight material and which have a diameter between about 0.1 mil and about 50 mils, are wrapped or otherwise imbedded along the axis of the sabot mold. What is meant by continuous is that the filaments are of length several times that of penetrator diameter and preferably the filaments are sufficiently long to be wrapped from the obturator rearward around the projectile base and back to the obturator.

Preferably, the sabot is formed with grooves to mesh with similar grooves on a penetrator body and some of the filaments are angled into said grooves.

What is claimed is:

1. A sabot for a projectile, said projectile having a high ratio of length to diameter, having a base and having buttress grooves thereon;

wherein said sabot comprises grooves which mesh with said buttress grooves of said projectile; and wherein said sabot is comprised of continuous filaments which wrap around the projectile base and diverge into the buttress grooves of said projectile.

* * * * *